US005308117A

United States Patent [19]

Yelton

[11] Patent Number: 5,308,117

[45] Date of Patent: May 3, 1994

[54] SWATCH BOOK FOR PAPER SWATCHES

[75] Inventor: Jeffrey L. Yelton, Sherwood, Wis.

[73] Assignee: Fox River Paper Company, Appleton, Wis.

[21] Appl. No.: 49,811

[22] Filed: Apr. 20, 1993

[51] Int. Cl.[5] ..... B42D 1/00

[52] U.S. Cl. ..... 281/15.1; 281/21.1; 281/29; 402/73

[58] Field of Search ..... 283/15.1, 21.1, 22, 283/28, 29, 34, 43, 44, 45; 402/73, 74, 76, 77, 70; 40/904; 206/450, 44.11, 44 B, 472

[56] References Cited

U.S. PATENT DOCUMENTS 1,577,558 3/1926 Brown et al. .
2,120,818 6/1938 Steinthal ..... 281/15.1 X
3,631,975 1/1972 Leibowitz ..... 281/29
4,129,212 12/1978 Hopkins ..... 271/15.1 X
4,139,216 2/1979 Saint Clair .
4,703,943 11/1987 Zelenko et al. ..... 281/21.1

*Primary Examiner*—Mark Rosenbaum
*Assistant Examiner*—Willmon Fridie, Jr.
*Attorney, Agent, or Firm*—Kinzer, Plyer, Dorn, McEachran & Jambor

[57] ABSTRACT

A swatch book for displaying sample swatches of paper. The book has non-integral front and rear covers of paper. The rear sheet has integral panels which are folded to form a sleeve which encompasses the front cover and the swatches of paper. Grommets extend through the sleeve, the cover sheets and the sample swatches to form a permanently bound book.

5 Claims, 2 Drawing Sheets

SWATCH BOOK FOR PAPER SWATCHES

BACKGROUND AND SUMMARY OF THE INVENTION

Swatch books are used by paper specifiers as well as paper retailers, distributors, and sales people to present samples or swatches of paper to customers. Swatch books for high grade communication papers should be attractive yet durable. It is also desirable that such swatch books be capable of displaying papers of different weights, grades and finishes to their best advantage. Swatch books should also be eye appealing and distinctive without requiring printed designs to provide their distinctiveness but instead should rely on the distinctiveness of the materials of the cover. The swatch book should also be capable of being hung on hooks and have edge surfaces for printed matter so they are identifiable from the tops and sides of a stack of hanging swatch books. It is also desirable to provide swatch books with strong covers instead of using rigid materials. Further, such swatch books should also be economical to manufacture.

Therefore, an object of this invention is a swatch book which is capable of displaying fine papers of various weights, colors, grades, and finishes such as bond, text and cover papers in an attractive manner.

Another object of this invention is a swatch book in which, whenever possible, the cover of the book may be formed from cover paper related to the swatches of bond, writing and text paper displayed in the book.

Another object of this invention is a swatch book in which the front and rear cover sheets may be made of papers of different colors, textures and finishes which may either be complementary or contrasting.

Another object of this invention is a swatch book in which the front and rear cover sheets may be formed of multiple thicknesses by using reverse folded sheets of paper.

Another object of this invention is a swatch book which is bound with grommets to allow the swatch book to be hung on hooks, chains, pegs, etc., for display and storage.

Another object of this invention is a swatch book having end and side spines capable of receiving printed matter for ease of identification.

Another object of this invention is a swatch book that appears to the viewer distinctly different than all other swatch books in the communication papers market.

Other objects of the invention may be found in the following specification, drawings and claims.

BRIEF DESCRIPTION OF THE DRAWINGS

The invention is illustrated more or less diagrammatically in the following drawings wherein.

DESCRIPTION OF THE PREFERRED EMBODIMENT

Figure 1:
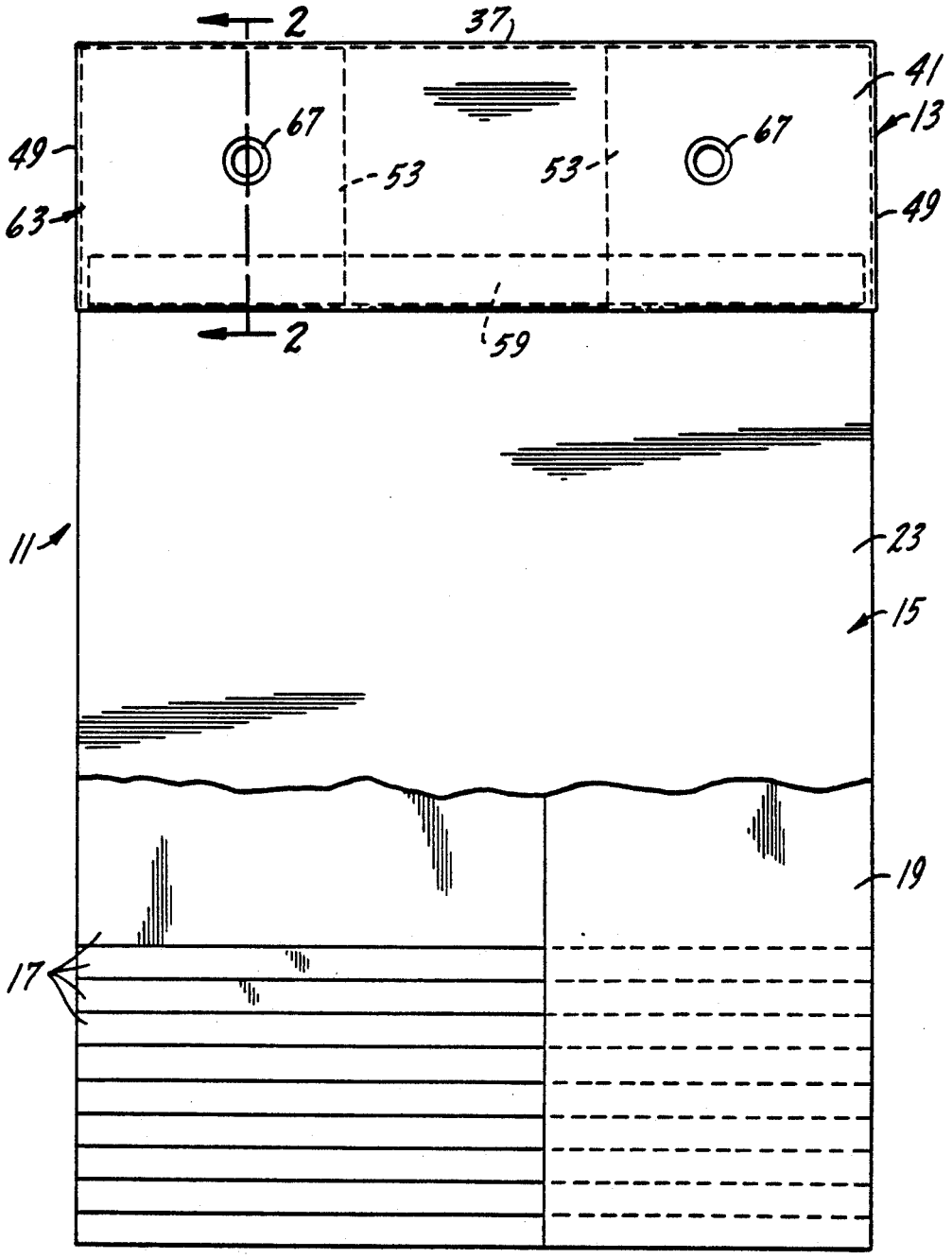
FIG. 1 is a top plan view of a swatch book of this invention with some parts broken away and concealed parts shown in dashed lines for clarity of illustration.

FIG. 1 of the invention shows a swatch book 11 made in accordance with the teachings of this invention. The swatch book includes a rear cover sheet 13 and a front cover sheet 15 which enclose swatch sheets 17 of various types, finishes, and grades of paper. As is conventional, the swatch sheets vary in length with the bottom most sheet being the longest and the top swatch sheet being the shortest with the bottom sheet being the full length of the booklet while the top sheet conventionally has a length equal to approximately $\frac{2}{3}$ the length of the booklet. This arrangement of swatch sheets which is called a stepped pattern provides a viewer with ready visual access to at least a portion of each of the swatch sheets in the booklet.

An index sheet 19 extending the length of the booklet and less than half the width thereof is positioned over the swatch sheet. Identification data (not shown) for the swatch sheets 17 may be printed on the index sheet in alignment with the stepped portions of the swatch sheets 17.

Figure 2:
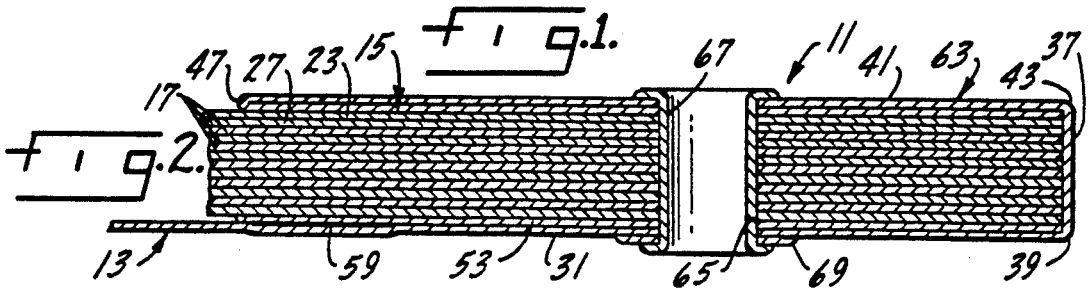
FIG. 2 is an enlarged cross sectional view taken along line 2—2 of FIG. 1.

As can be best seen in FIG. 2 of the drawings, the front cover sheet 15 has a front panel 23 which is reversely folded against a reflex panel 27 to provide a double thickness front cover sheet.

Figure 3:
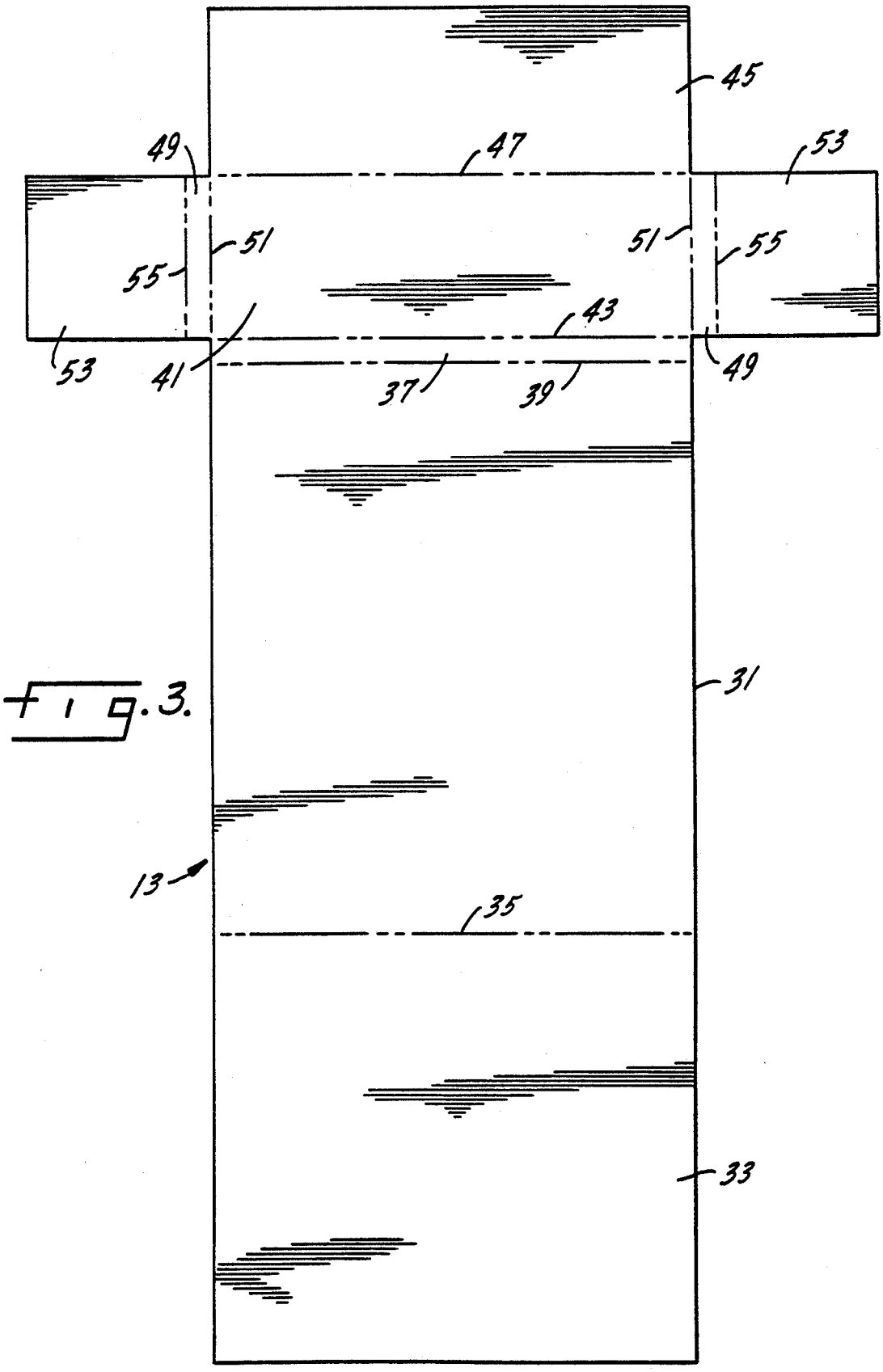
FIG. 3 is a plan view of the rear cover sheet of the swatch book of FIG. 1 prior to installation in the swatch book with its integral panels shown prior to folding.

As shown most clearly in FIG. 3 of the drawings, the rear cover sheet 13 is cut from a larger sheet of paper (not shown) to provide a cover with an integral main panel 31 having a flap panel 33 connected thereto by a fold line 35. An end spine panel 37 is connected to the opposite end of the main panel by a fold line 39. A top panel 41 is connected to the end spine panel 37 by a fold line 43. A reflex end panel 45 is formed integrally with and connected to the top panel 41 by a fold line 47. Additional portions of the integral rear cover sheet 13 include a pair of side spine panels 49 connected to the opposite sides of the top panel 41 by fold lines 51. A reflex side panel 53 is integrally formed with each end spine panel and is connected thereto by a fold line 55.

In assembling the swatch book 11, the reflex end panel 45 is folded over against the top panel 41 about the fold line 47. The reflex panel 27 of the front cover sheet is reversely folded against the front panel 23. The stepped swatch sheets 17 and index sheet 19 are placed face down against the reflex panel 27. The folded front cover sheet, index sheet, and swatch sheets are then placed on the reflex end panel 45 of the rear cover sheet 13 and the side spine panels 49 and the reflex side panels 53 are folded about their respective fold lines 51 and 55 against and over the swatch sheets.

A piece of double sided tape 59 is then affixed to the folded reflex side panels 53 and the adjacent swatch sheet 17 to hold them together. The flap panel 33 of the rear cover sheet 13 is reversely folded against the main panel 31 about fold line 35 and this folded sheet is then positioned against the double sided tape 59 and the swatch sheets 17 to form a sleeve 63. Holes 65 are then drilled through the sleeve 63 and hollow grommets 67 are inserted through the holes and deformed against an integral grommet ring 69 to form a secure bound swatch book 11.

In its final form, the swatch book 11 has a front cover sheet 15 of double thickness with the free end of the sheet having a French Fold. Further, the rear cover sheet 13 at its free end remote from the binding may also have a French Fold 35. The swatch book 11 also has an end spine panel 37 and partial side spine panels 49 which are sufficiently wide to receive printing which may identify the contents of the swatch book. The rear cover sheet 13 and front cover sheet 15 may be formed of sheets of paper that are of different colors, either complementary or contrasting, and these sheets may also be related in color, texture, or type to the papers shown in the swatch book.

I claim:

1. A swatch book for displaying sample swatches of paper, said swatch book having a front cover sheet and a rear cover sheet which are non-integral, said rear cover sheet having integral panels which are folded to encompass said front cover sheet and said sample swatches, and fastening means extending through said front cover sheet, said integral panels, said rear cover sheet and said sample swatches to form a permanently bound book.

2. The swatch book of claim 1 in which said rear cover sheet includes a main panel, a top panel adjacent said main panel, and side panels adjacent said top panel, said top panel being folded over the main panel and said sample swatches and said side panels being folded between said swatches and said main panel.

3. The swatch book of claim 2 in which said rear cover sheet has an end spine panel located between said main panel and said top panel and partial side spine panels located between said top panel and said side panels.

4. The swatch book of claim 2 in which said side panels extend toward but terminate short of each other when folded between said swatches and said main panel.

5. The swatch book of claim 1 in which said fastening means are grommets.

* * * * *